United States Patent [19]

Colonneau

[11] 4,236,335

[45] Dec. 2, 1980

[54] DISPLAY DEVICE

[76] Inventor: Jean Colonneau, 156, rue du Grand Parc, St. Sebastien de Morsent, France

[21] Appl. No.: 952,615

[22] Filed: Oct. 18, 1978

[30] Foreign Application Priority Data

Oct. 26, 1977 [FR] France ..... 77 32248

[51] Int. Cl.[3] ..... G09F 13/00; G09F 27/00

[52] U.S. Cl. ..... 40/442; 40/455; 40/540; 40/553; 40/902; 40/906; 200/40; 368/12

[58] Field of Search ..... 40/445, 447, 429, 442, 40/902, 553, 453, 906, 455; 362/251; 58/152 B, 19 C, 50 R; 46/226, 227, 228, 229; 200/40

[56] References Cited

U.S. PATENT DOCUMENTS

| | | | |
|---|---|---|---|
| 811,589 | 2/1906 | Shatto et al. | 200/40 |
| 862,344 | 8/1907 | Neumann et al. | 200/40 |
| 870,404 | 11/1907 | Wood | 200/40 |
| 1,037,818 | 9/1912 | Brown | 200/40 |
| 2,821,621 | 1/1958 | Allunario | 40/553 |
| 3,696,358 | 10/1972 | Vasku | 40/906 X |

FOREIGN PATENT DOCUMENTS

| | | | |
|---|---|---|---|
| 1021897 | 2/1953 | France | 58/19 C |

*Primary Examiner*—John F. Pitrelli
*Assistant Examiner*—G. Lee Skillington
*Attorney, Agent, or Firm*—Sandler & Greenblum

[57] ABSTRACT

A miniaturized housing or display device including at least one electric circuit adapted to be connected to an electric current supply. The electric circuit includes at least one switch. The housing further is adapted to receive a mechanical alarm clock that has a movement winder and an alarm winder. A counterweight is attached to hang from each of the winders such that each of the counterweights abuts against a corresponding switch in each of the circuits when the mechanical alarm clock is inserted in the compartment and the counterweights descend as a result of the movement of each of the winders.

9 Claims, 6 Drawing Figures

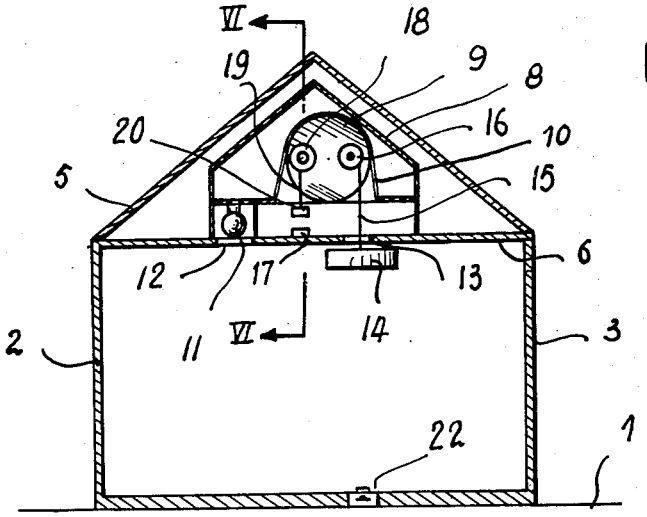
FIG. 3
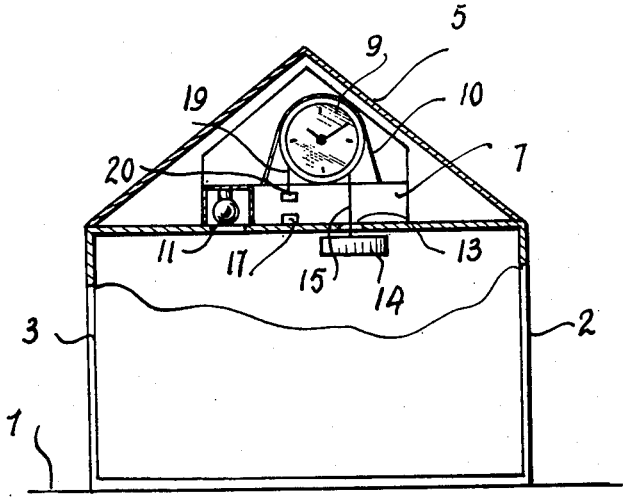
FIG. 4
FIG. 5
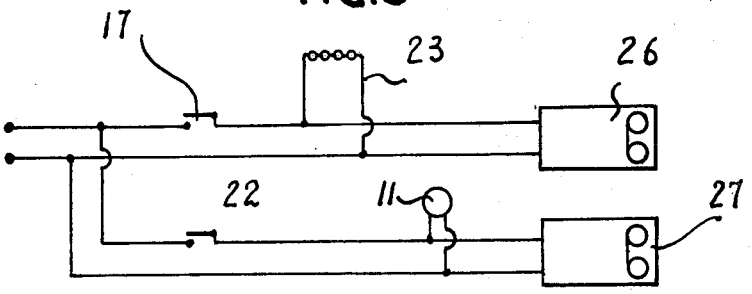

DISPLAY DEVICE

BACKGROUND OF THE INVENTION

1. Field of the Invention

The invention relates to a novel toy, such as a playhouse or crèche. The term "crèche" is taken to include those structures and housings normally embodying nativity scenes and the like which find common usage prior to and during the Christmas season.

2. Summary of the Invention

It is an object of the invention to provide a toy children will find particularly attractive while nevertheless having a very simple design.

It is a further object of the invention to provide a creche which is both amusing and attractive.

According to the invention a miniaturized housing is provided which comprises at least one electric circuit adapted to be connected to an electric current supply. Each electric circuit comprises at least one switch. The housing further comprises receiving means adapted to receive a mechanical alarm clock comprising a movement winder and an alarm winder. The clock to be received has a counterweight attached to hang from each of the winders and the receiving means is arranged such that each of the counterweights abuts against a corresponding switch in each of the circuits when the mechanical alarm clock is inserted in the receiving means and the counterweights descend as a result of movement of each of said winders.

In one embodiment of the invention the housing comprises first and second electric circuits. The first electric circuit comprises a first switch as well as illumination means for illuminating the exterior of the housing and a motor of a first tape recorder. The second electric circuit comprises a second switch together with second illumination means for illuminating the interior of the housing and a motor of a second tape recorder. The first and second switches are arranged beneath the receiving means such that each of the counterweights abuts a corresponding switch as the counterweights move in response to movement by each of the winders. The counterweights may be operatively associated with each of the winders by means of a pulley system which is adapted to lower each of the counterweights as the winders rotate.

In a further embodiment of the invention each of the switches used is a contact switch which comprises a strip connected at one end thereof to the circuit and is spaced from a contact in the circuit at its other end. The strip is adapted to touch the contact as the corresponding counterweight abuts against the strip.

BRIEF DESCRIPTION OF THE DRAWINGS

FIG. 3 illustrates a cross sectional view along the line III—III of FIG. 1;

FIG. 4 is a rear view of the crèche according to the invention in partial cross section;

FIG. 5 schematically illustrates the circuitry of the crèche; and

DESCRIPTION OF PREFERRED EMBODIMENTS

Figure 1:
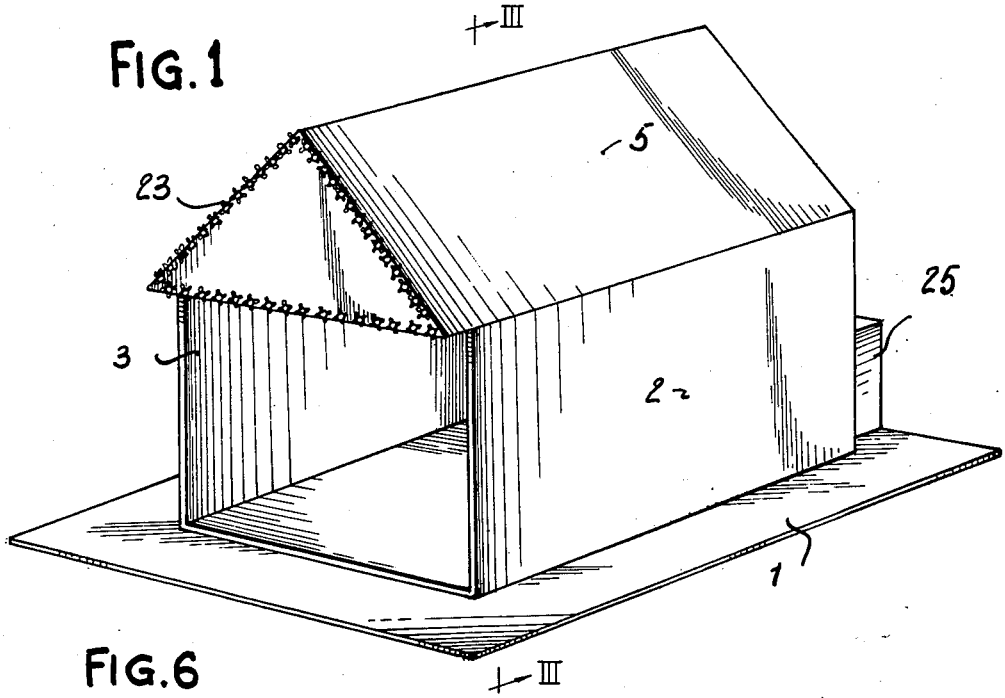
FIG. 1 is a perspective view of the creche according to the inventor.

The toy of the invention may comprise a member having the shape of a miniaturized building or housing and comprises at least one electric circuit adapted to be connected to a suitable electric current source which itself includes at least one switch. The electric circuit may additionally comprise different electrical devices such as a lamp and the motor of a tape recorder. Furthermore, the housing or body further comprises means for receiving a mechanical alarm clock in its upper section which comprises a movement winder and an alarm winder, the term "winder" being used to define the wind-up mechanism commonly associated with non-electric alarm clocks. Each of the winders is adapted to be connected to a pulley having a wire, cord, or the like coiled around it. The free end of the wire or cord carries a counterweight and the switches are arranged such that the counterweights abut with the switches so as to close the electric circuit when the wire coiled on the pulleys is unwound as a result of the control being asserted by the rotation of the winders.

By virtue of the structure of the invention, a toy is produced which, although having a very simple design, is nevertheless very attractive. Simplicity results because the alarm clock is regulated in such a way so as to control the illumination of certain sections of the body of the miniature housing as well as to control the motor of a tape recorder so that it is possible to play a previously recorded musical piece while the housing is being illuminated.

In one embodiment, the toy comprises a first electric circuit which includes a switch, lamps for lighting up the exterior of the housing, and the motor of a first tape recorder. A second electric circuit includes a switch, lamps for lighting up the interior of the housing, and the motor of a second tape recorder. The first switch of the first electric circuit is arranged so as to be closed when it is contacted by the counterweight connected to the free end of the wire coiled over the pulley controlled by the movement winder of the mechanical alarm clock. The second switch is arranged so as to be closed when it receives the counterweight connected to the free end of the wire coiled around the pulley controlled by the rotation of the winder of the bell, alarm or striker mechanism.

As a result of the unique arrangement of the invention, it is possible to successively control the effects which are achieved thus providing a very interesting display.

According to one specific embodiment of the invention, the switches are contact switches comprising a resilient strip secured at one end to a conductor wire connected to the electric circuit while the other end is resiliently spaced from a contact connected to the remainer of the electric circuit by means of a conductor wire.

In yet another embodiment of the invention, the housing or building may externally comprise a container adapted to receive the tape recorders to be used.

As seen from the drawings, a creche or miniature building comprises a base 1, having three side walls 2, 3, and 4, a roof 5 and a ceiling 6. The roof is hinged, preferably at its base so that the roof may be lifted to provide access to mechanism fitted within the receiving means contained between the roof 5 and the ceiling 6.

Obviously, other suitable means of access may likewise be provided.

Figure 2:
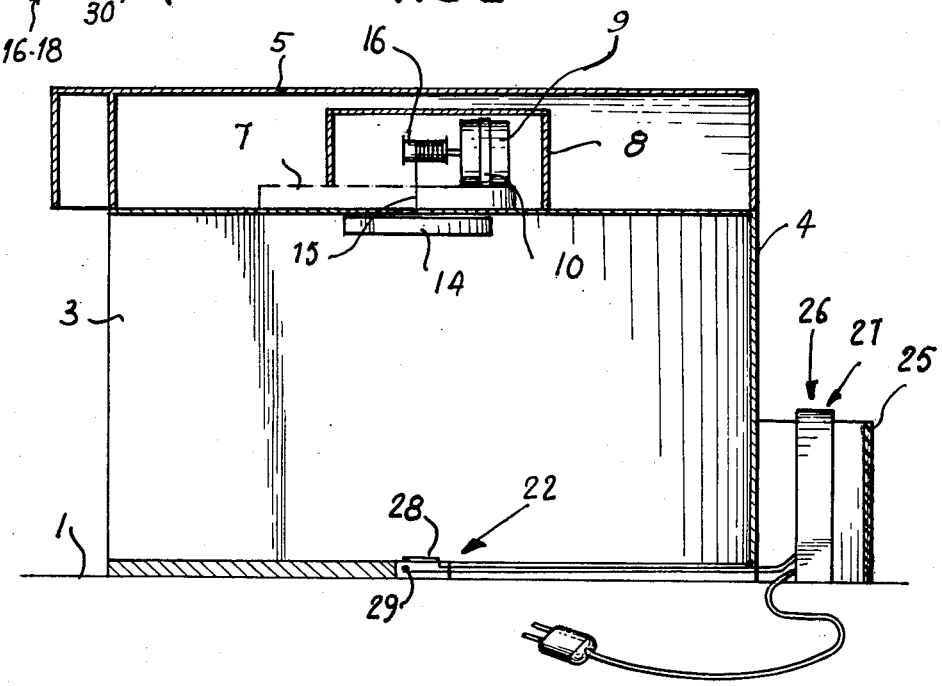
FIG. 2 is a longitudinal cross sectional view of the crèche.

As shown in FIGS. 2, 3, and 4, a receiving means comprising a base or support 7 is provided on the ceiling. The base is enclosed by a cover 8 which is covered by a material which acts as a sound absorber so that alarm clock 9 arranged on the base and attached thereto by means of a strap 10 cannot be heard.

The receiving means comprises a first base or seating, in which a bulb 11 is arranged so as to face an opening 12 in the ceiling. A second opening 13 is also provided in the ceiling and is adapted to receive a moveable body 14 which, is shown by way of example, is formed by a cradle or rocker member acting as a counterweight attached to the end of a band, wire or rope wound around a pulley 16.

The pulley 16 may, for example, comprise a reel fitted onto a shaft or spindle of the winder mechanism of the alarm bell 9. A pulley 18 is fitted on the shaft of the winder of the alarm mechanism and a wire, cord or the like 19 is wound around the reel with its free end connected to a counterweight 20.

Figure 6:
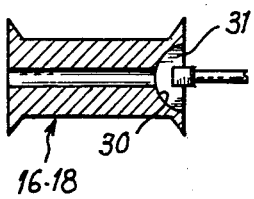
FIG. 6 is a magnified cross sectional view of the pulley along VI–VI of FIG. 3

As shown in FIG. 6, pulleys 16 and 18 comprise a diametrical slot 30 adapted to receive the corresponding winder 31 of the alarm clock.

A switch 17 is provided on the upper surface of the ceiling 6, in alignment with the counterweight 20. Likewise, a switch 22 is provided at the base 1 and is aligned with the counterweight 14.

As shown in FIG. 1, the creche may be decorated with a luminous garland display 23 which is included within the electric circuit governed by the switch 17.

FIG. 2 illustrates a mounting 25 arranged on end wall 4 which is adapted to contain two tape recorders 26 and 27.

Switches 17 and 22 may preferably be formed by means of an electric contact strip 28, whose one end is connected to a conductor wire, while its other end, in normal position, is spaced from a contact 29 connected to the other conductor wire forming the remainder of the circuit.

As shown in FIG. 5, two electric circuits are provided. The first circuit comprises a switch 17, a luminous garland 23 and a tape recorder 26 while the second circuit comprises switch 22, bulb 11 and tape recorder 27. In operation, the alarm clock is wound up, and the bell or striker mechanism is set to a predetermined time, for example, midnight. The height of the counterweight 20 with respect to the switch 17 is adjusted such that, for example, a few minutes before midnight the counterweight comes into contact or abuts with the switch thus closing the first electric circuit so that garland 23 is lit up and tape 26 is supplied with current. The tape recorder 26 may contain a tape having prerecorded Christmas carols and the like.

When the bell or alarm mechanism of the mechanical alarm clock 9 is set off, wire 15 is unwound and the counterweight 14 abuts or engages switch 22 thus closing the second circuit. At this moment the bulb 11 lights up illuminating the interior of the creche while the second tape recorder 27 is supplied with current thus enabling it to broadcast, for example, the sounds of bells or the like which have been previously recorded.

It is understood that the mechanical alarm clock of the invention comprises two winders each of which is adapted to unwind, i.e., rotate in an opposite direction as the movement which they control exhausts itself. In this way the pulleys are each rotated as required to provide the necessary movement and providing the desired result.

The invention has been described with respect to specific embodiments. It is to be understood that the invention is not limited to these embodiments and is to be construed only is light of the claims.

What is claimed is

1. A display device comprising:

(a) a housing; and (b) first and second electric circuits, associated with said housing, said first electric circuit comprising a first switch, illumination means for illuminating the exterior of said housing, and a motor of a first tape recorder; said second electric circuit comprising a second switch, second illumination means for illuminating the interior of said housing, and a motor of a second tape recorder; each of said first and second electric circuits being adapted to be connected to an electric current supply; and (c) receiving means, associated with said housing, adapted to receive a mechanical alarm clock comprising a movement winder and an alarm winder, said clock having a counterweight attached to hang from each of said winders, said receiving means being arranged such that each of said counterweights abuts against a corresponding switch in each of said circuits when said mechanical alarm clock is inserted in said receiving means and said counterweights descend as a result of the movement of each said winders; and (d) wherein said first and second switches are arranged beneath said receiving means such that each of said counterweights abuts against a corresponding one of said switches as said counterweights descend in response to movement by each of said winders.

2. The display device as defined by claim 1 comprising a mechanical alarm clock, said alarm comprising a movement winder and an alarm winder.

3. The display device as defined by claim 2 wherein each of said counterweights is connected to each of said winders by a pully system adapted to be wound around each of said winders and which is adapted to lower each of said counterweights as said winders rotate.

4. The display device as defined by claim 3 wherein each of said switches is a contact switch comprising a strip connected at one end thereof to said circuit and spaced from a contact in said circuit at the other end thereof, said strip being adapted to touch said contact as said corresponding counterweight abuts against said strip.

5. The display device as defined by claim 4 wherein said housing comprises a compartment at the rear of said housing adapted to receive each of said tape recorders.

6. The display device as defined by claim 5 comprising two of said tape recorders in said compartment.

7. The display device as defined by claim 1 further comprising a compartment adapted to receive two tape recorders.

8. The display device as defined by claim 1 wherein said receiving means further comprises soundproofing means.

9. The display device as defined by claim 1, wherein said housing is a creche.

* * * * *